US006514359B2

(12) United States Patent
Kawano

(10) Patent No.: US 6,514,359 B2
(45) Date of Patent: Feb. 4, 2003

(54) HEAT RESISTANT STEEL

(75) Inventor: Kaori Kawano, Neyagawa (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/818,830

(22) Filed: Mar. 28, 2001

(65) Prior Publication Data

US 2001/0035235 A1 Nov. 1, 2001

(30) Foreign Application Priority Data

Mar. 30, 2000 (JP) ..... 2000-093827
Jan. 30, 2001 (JP) ..... 2001-021239

(51) Int. Cl.[7] ..... C22C 38/24
(52) U.S. Cl. ..... 148/328; 148/333; 148/334; 148/335
(58) Field of Search ..... 148/328, 333, 148/334, 335

(56) References Cited

U.S. PATENT DOCUMENTS 5,310,431 A 5/1994 Buck ..... 148/325

FOREIGN PATENT DOCUMENTS

| | | |
|---|---|---|
| EP | 0 560 375 A2 | 9/1993 |
| JP | 52-133018 | 11/1977 |
| JP | 63-18038 | 1/1988 |
| JP | 1-316441 | 12/1989 |
| JP | 2-217439 | 8/1990 |
| JP | 6-220532 | 8/1994 |
| JP | 8-134585 | 5/1996 |
| JP | 2000-204434 | 7/2000 |
| WO | WO 96/14445 | 5/1996 |

OTHER PUBLICATIONS

N. Gope et al., "Influence of long–term aging and superimposed creep stress on the microstructure of 0.50 Cr–0.50 Mo–0.25 V steel", Metallurgical Transactions A (Physical Metallurgy and Materials Science) Aug. 1992, vol. 23A, No. 8, pp. 2193–2204 (Abstract) (Document No. XP–002172657).

A. Tohyama et al. "Development of 2Cr–Mo–W–Ti–V–B ferritc steel for ultra super critical boilers (NKK Tempaloy F–2W)", 1, Materials For Advanced Power Engineering 1998, Pt. 1, pp. 431–440 (Abstract) and Chemical Abstracts, vol. 130, Feb. 8, 1999 No. 6, Abstract No. 69382w, (Document No. XP–002172656).

*Primary Examiner*—Deborah Yee
(74) *Attorney, Agent, or Firm*—Armstrong, Westerman & Hattori, LLP

(57) ABSTRACT

A heat resistant steel which comprises, by mass %, C: 0.01–0.25%, Cr: 0.5–8%, V: 0.05–0.5%, Si: not more than 0.7%, Mn: not more than 1%, Mo: not more than 2.5%, W: not more than 5%, Nb: not more than 0.2%, N: not more than 0.1%, Ti: not more than 0.1%, Ta: not more than 0.2%, Cu: not more than 0.5%, Ni: not more than 0.5%, Co: not more than 0.5%, B: not more than 0.1%, Al: not more than 0.05%, Ca: not more than 0.01%, Mg: not more than 0.01%, Nd: not more than 0.01%, with Fe and impurities accounting for the balance, the chemical composition of which satisfies the relations $C-0.06\times(Mo+0.5\ W)\geqq 0.01$ and $Mn+0.69\times\log(Mo+0.5\ W+0.01)\leqq 0.60$ wherein the symbols for elements represent the contents, on the % by mass basis, of the elements in the steel, and in which, among precipitates inside grains, precipitates having an average diameter of not more than 30 nm are present at a density of not less than $1/\mu m^3$.

20 Claims, No Drawings

HEAT RESISTANT STEEL

This application claims priority under 35 U.S.C. § §119 and/or 365 to Japanese Patent Application Nos. 2000-093827 and 2001-021239 filed in Japan on Mar. 30, 2000 and Jan. 30, 2001, respectively, the entire content of which is herein incorporated by reference.

FIELD OF THE INVENTION

This invention relates to a heat resistant steel having a Cr content of not more than 8% by mass and suited for such uses as heat exchangers, steel pipes for piping, heat resistant valves and members or parts required to be welded in the fields of boilers, chemical industries and nuclear energy utilization, among others, in particular to a heat resistant steel having a Cr content of not more than 8% by mass and excellent in creep strength at elevated temperatures not lower than 400° C. and in toughness. In the description which follows, a Cr steel having a Cr content of not more than 8% by mass is referred to as "low/medium Cr steel".

BACKGROUND OF THE INVENTION

So far, in high temperature environments not lower than 400° C., austenitic stainless steels, Cr steels with a Cr content of 9 to 12% by mass (hereinafter referred to as "high Cr steels"), low/medium Cr steels and carbon steels have been used selectively in respective matched fields taking into consideration both the environment (e.g. temperature, pressure) and the economical feature.

Among the various heat resistant steels mentioned above, low/medium Cr steels contain Cr and therefore are superior to carbon steels in oxidation resistance, high temperature corrosion resistance, strength at elevated temperatures and creep strength. Furthermore, although low/medium Cr steels are inferior to austenitic stainless steels in strength at elevated temperatures or creep strength, they have smaller thermal expansion coefficient and, in addition, are much more inexpensive. Comparing with the high Cr steels as well, low/medium Cr steels are more inexpensive and are characterized in that they have superior in toughness, weldability and heat conductivity.

Therefore, the so-called "Cr—Mo steels", namely the low/medium Cr heat resistant steels have been used in many instances, for example the steels STBA 20, STBA 22, STBA 23, STBA 24 and STBA 25 as defined in JIS G 3462, also known as 0.5 Cr-0.5 Mo steel, 1.0 Cr-0.5 Mo steel, 1.25 Cr-0.5 Mo steel, 2.25 Cr-1.0 Mo steel and 5.0 Cr-0.5 Mo steel, respectively, based on the Cr and Mo contents on the % by mass basis.

Meanwhile, improvements in strength at elevated temperatures and creep strength of low/medium Cr heat resistant steels have so far been achieved by addition of V, Nb, Ti, Ta and the like, which are precipitation strengthening elements. Well known as such precipitation-strengthened low/medium Cr heat resistant steels are, for instance, 1% Cr-1% Mo-0.25% V steel, which is a material for turbines, and 2.25% Cr-1% Mo—Nb steel, which is a material of construction of fast breeder reactors, so called based on the contents on the % by mass basis.

Furthermore, low/medium Cr ferritic steels of the precipitation strengthening type have been disclosed in patent specifications, for example in J P Kokai S63-18038, J P Kokai H01-316441, J P Kokai H02-217439, J P Kokai H06-220532, J P Kokai H08-134585 and WO 96/14445.

SUMMARY OF THE INVENTION

Generally, the strength at elevated temperatures and creep strength of heat resistant steels are very important in designing pressure members or parts, and are desired to have high strength regardless of the temperature the steel is to be used. In particular, in the case of heat-resistant pressure steel pipes used in boilers, chemical industries, nuclear energy utilization and like fields, steels having high strength at elevated temperatures and creep strength are required, and the wall thicknesses of the steel pipes are determined based on the strength at elevated temperatures and creep strength of the materials. Therefore, improvements in strength at elevated temperatures and creep strength of low/medium Cr steels have so far been achieved by solid-solution strengthening and precipitation strengthening. However, the strength at elevated temperatures and the creep strength after a long period of use are not always compatible with each other.

The improvements in strength at elevated temperatures of low/medium Cr heat resistant steels have been generally achieved by increasing the contents of C, Cr, Mo and W. However, in the case of steels having increased strength at elevated temperatures as a result of containing these alloying elements beyond their solubility limit, carbides and/or intermetallic compounds, which comprise C, Cr, Mo and W as main components, may precipitate after a long period of use at elevated temperatures, leading to decreases in creep strength on the higher temperature after a long period of use. Thus, even the conventional "Cr—Mo steels" cannot avoid this problem.

On the other hand, when the strength, in particular strength at elevated temperatures, of low/medium Cr steels is increased by precipitation strengthening, no adequate metallographic control leads to the following problems.

(a) Although unused materials or materials used for only short period of time exhibit high strength at elevated temperatures and high creep strength, materials used at elevated temperatures for 10,000 hours or longer reduce effects of precipitation, so that they may not have stable strength at elevated temperatures and creep strength any longer. This is because while carbides, nitrides and intermetallic compounds contribute to precipitation strengthening in unused materials or materials used for only short period of time, the aging occurring during a long period of time at elevated temperatures results in coarsening of these precipitates, whereby the precipitation strengthening effect may be lost.

(b) In precipitation hardening steels, the grain inside has been strengthened, so that the strength of grain boundaries is relatively weak, and this may lead to deteriorations in toughness and corrosion resistance.

(c) When the microstructure of a steel is a dual-phase consisted of bainite and ferrite or martensite and ferrite, fine precipitates are precipitated inside bainite or martensite, whereby the strength at elevated temperatures and creep strength increase whereas, in ferrite, the precipitates easily become coarsened and the precipitation strengthening effect reduces. Thus, the each phase forming the above dual phase exhibits different deformabilities (e.g. strength at elevated temperatures and ductility) and the toughness and/or creep strength may deteriorate. Further, during use at elevated temperatures, the precipitates may become coarsened at the boundary between bainite and ferrite or at the boundary between martensite and ferrite, leading to deterioration in toughness and/or fatigue property.

Therefore, 1% Cr-1% Mo-0.25% V steel, 2.25% Cr-1% Mo—Nb steel and the precipitation strengthening type low/medium Cr steels proposed in the above-cited patent specifications have the following problems, respectively.

In the case of 1% Cr-1% Mo-0.25% V steel, the amount of V carbonitride precipitates becomes excessive and, in addition, the precipitates readily become coarsened and, therefore, the toughness and/or creep strength may deteriorate.

In the case of 2.25% Cr-1% Mo—Nb steel, grain boundary precipitates such as $M_6C$ carbides readily become coarsened and the amount of Mo in solid solution in the matrix rather decreases, so that the toughness and creep strength may deteriorate.

In the case of the 3% Cr-1% Mo—W—V steel proposed in J P Kokai S63-18038, $M_6C$ carbides are easy to precipitate and the amounts of Mo and W in solid solution in the matrix rather decrease, leading to deterioration in creep strength, in particular creep strength after a long period of use where the time to rupture exceeds 6,000 hours, as the case may be.

The "heat resistant steel excellent in toughness" proposed in J P Kokai H01-316441 is a heat resistant steel based on Cr—Mo steel and containing V. However, it is necessary that the metallography should be of the dual phase comprising ferrite and bainite or ferrite and pearlite. Furthermore, as described in the example section, the ferrite phase content is not less than 70%. Therefore, it is poor in strength at elevated temperatures in some instances.

The "high strength low alloy steel excellent in corrosion resistance and oxidation resistance" proposed in J P Kokai H02-217439 is a heat resistant steel based on Cr—Mo steel and containing V, Nb, Cu, Ni, etc. However, for the steel disclosed in the above-cited publication, no attention has been paid to the precipitates in the microstructure, and $M_6C$ carbides may easily precipitate depending on the content balance among C, Mn, Mo and W. Thus, one of the strength at elevated temperatures, creep strength and toughness may deteriorate in certain instances.

The steel described in J P Kokai H06-220532 is a high yield ratio, high toughness, non-heat treated high strength steel based on a Cr—Mo steel and contains Nb, V, Ti and B and comprises a bainite phase with a proeutectoid ferrite area percentage of not higher than 10%. For this steel, however, no consideration is given to the precipitates in the microstructure and $M_6C$ carbides may easily precipitate depending on the content balance among C, Mn, Mo and W. Thus, one of the strength at elevated temperatures, creep strength and toughness may deteriorate as the case may be.

Further, the "ferritic heat resistant steel excellent in strength at elevated temperatures and oxidation resistance" proposed in J P Kokai H08-134585 and the "ferritic heat resistant steel excellent in strength at elevated temperatures" proposed in WO 96/14445 each is a steel based on Cr—Mo steel and containing V, Nb and B, with a microstructure comprising not more than 15%, in sectional area percentage, of proeutectoid ferrite, with the balance being bainite. For the steels disclosed in the above two publications, no consideration is made concerning the precipitates in the microstructure of the steels and, furthermore, $M_6C$ carbides may easily precipitate depending on the content balance among C, Mn, Mo and W and, thus, one of the strength at elevated temperatures, creep strength and toughness may deteriorate as the case may be.

If the strength at elevated temperatures and creep strength of low/medium Cr heat resistant steels, having above-mentioned various problems can successfully be still more increased, the following advantages will be obtained.

While so far, for securing strength at elevated temperatures and creep strength, high Cr steels have been used even in use environments where high temperature corrosion resistance is not so strictly required, the characteristic features of low/medium Cr steels, for example good weldability, as well as the economically advantageous, if low/medium Cr steels can be used instead of high Cr steels.

In the conventional fields of application as well, it will become possible to reduce the wall thickness to thereby improve the heat conductivity and thus improve the very thermal efficiency of plants. Thus, it will be also possible to reduce the thermal stress resulting from starting and stopping of plants.

Furthermore, owing to weight reductions resulting from the reduction in wall thickness, it will become possible to make plants compact and reduce the production cost.

Accordingly, it is an object of the present invention to provide a heat resistant steel containing not more than 8% by mass of Cr and showing high creep strength at elevated temperatures not lower than 400° C., in particular at temperatures of about 400 to 600° C., and showing stable strength at elevated temperatures even after a long period of use in such temperature range and, furthermore, showing excellent toughness.

The gist of the present invention is as follows.

Thus, it lies in "a heat resistant steel which comprises, by mass %, C: 0.01–0.25%, Cr: 0.5–8%, V: 0.05–0.5%, Si: not more than 0.7%, Mn: not more than 1%, Mo: not more than 2.5%, W: not more than 5%, Nb: not more than 0.2%, N: not more than 0.1%, Ti: not more than 0.1%, Ta: not more than 0.2%, Cu: not more than 0.5%, Ni: not more than 0.5%, Co: not more than 0.5%, B: not more than 0.1%, Al: not more than 0.05%, Ca: not more than 0.01%, Mg: not more than 0.01%, Nd: not more than 0.01%, with Fe and impurities accounting for the balance, the chemical composition of which satisfies the relations (1) and (2) given below and in which, among precipitates inside grains, precipitates having an average diameter of not more than 30 nm are present at a particle density of not less than $1/\mu m^3$ (namely, 1 particle per 1 $\mu m^3$)."

$$C-0.06\times(Mo+0.5\ W)\geqq 0.01 \quad (1)$$

$$Mn+0.69\times\log(Mo+0.5\ W+0.01)\leqq 0.60 \quad (2)$$

In the above formulas (1) and (2), the symbols for elements represent the contents, on the % by mass basis, of the elements in the steel.

The term "average diameter" as used herein specifically means the value defined as ½ of the sum of the major axis length and the minor axis length.

The "precipitates having an average diameter of not more than 30 nm" as so defined herein can readily be observed by observation using a transmission electron microscope at an accelerating voltage of not lower than 100 kV. In particular when an ultrahigh voltage transmission electron microscope is used, for example at an accelerating voltage of 3,000 kV, it is possible to observe the objects in the atomic level, the lower limit to the average diameter of the above precipitates may be set at about 0.3 nm corresponding to the lattice constant of Fe or the precipitates. At an ordinary accelerating voltage (e.g. 100–200 kV), however, those having an average diameter of 2 nm or smaller are out of the resolving power of a transmission electron microscope and may not be distinctly identified. Therefore, it is practical to set the lower limit to the average diameter of the above precipitates at 2 nm.

The low/medium Cr heat resistant steel of the present invention may be either a forging steel or a cast steel.

DETAILED DESCRIPTION OF THE INVENTION

The present inventors made various investigations concerning the relations between the chemical composition of low/medium Cr heat resistant steel with a Cr content of not more than8% by mass, precipitates therein and the matrix microstructure, on one hand, and, on the other, the toughness, creep strength and strength at elevated temperatures not lower than 400° C., in particular in the temperature range of 400–600° C. and, as a result, obtained the following findings.

1. When $M_6C$ carbides precipitate at grain boundaries, one of the creep strength, strength at elevated temperatures and toughness is reduced. When, however, the contents of C, Mn, Mo and W satisfy the relations (1) and (2) given above in low/medium Cr heat resistant steels having a specific chemical composition, $M_6C$ carbides will not precipitate out. Furthermore, the amount of solute Mo and/or the amount of solute W, which is effective for the creep strength after a long period of use, can be secured.

2. V is hardly dissolved in $M_6C$ carbides. In other words, V is scarcely contained among the metal elements M in $M_6C$ carbides.

3. When fine precipitates having an average diameter of not more than 30 nm are present inside grains with a density of not less than $1/\mu m^3$, the strength at elevated temperatures and creep strength of low/medium Cr heat resistant steel are increased due to the precipitation strengthening effect.

4. The precipitates having an average diameter of not more than 30 nm and precipitating inside grains as "coherent precipitates" lead to more increased strength at elevated temperatures and creep strength.

The term "coherent precipitates" as used herein collectively means those fine carbides, nitrides or carbonitrides and mixed precipitates of them precipitated inside grains which may be represented by MX, where M is a metal element with V, Nb, Ti, Ta and the like as main constituents and X is C or N, including VC, VN, NbC, NbN, TiC, TiN, TaC, TaN, etc., or by $M_2X$, where M is a metal element with Mo and Cr as main constituents and X is C or N, including $Mo_2C$, $Cr_2N$, etc. Hereinafter, the above coherent precipitates are sometimes referred to also as MX type precipitates for short. The term "coherent precipitates" includes those precipitates for which the interface between the matrix and the precipitate is partly coherent, with interface dislocations existing there.

When the precipitates with an average diameter of not more than 30 nm precipitating inside grains are "coherent precipitates", the effect of (4) may be obtained by the following reasons.

4-1: The above-mentioned MX type precipitates have a spherical shape in the early stage of precipitation at elevated temperatures and have the same body centered cubic structure (bcc) as the matrix and are in an entirely coherent relationship with the matrix.

4-2: Although the structure of these MX type precipitates is converted to the face centered cubic structure (fcc) due to tempering or high temperature aging during use and, on that occasion, their shape changes into thin disks, they retain a coherent relationship with the matrix while they have a disk-like shape.

4-3: While the MX type precipitates retain coherence with the matrix, dislocations are pinned by coherent strains generated around the MX type precipitates and it becomes difficult for the dislocations to move and, accordingly, the recovery softening of the matrix structure is suppressed and, at the same time, the deformation resistance is increased. Further, dislocations otherwise moving on the occasion of plastic deformation are also pinned, so that the deformation resistance is increased. As a result, the strength at elevated temperature and creep strength are increased.

4—4: While the MX type precipitates retain coherence with the matrix, the MX type precipitates are strained by the matrix, so that the growth and coarsening of the MX type precipitates themselves are suppressed. Therefore, the fine MX type precipitates are retained stably and at high densities and the precipitation strengthening effect is maintained over a long period of use at elevated temperatures; stable strength at elevated temperatures and creep strength are thus obtained.

5. For not only increasing the strength at elevated temperatures and creep strength of a low/medium Cr heat resistant steel but also increasing the creep rupture ductility and toughness thereof, it is preferable to consider the precipitates at grain boundaries besides $M_6C$ carbides as well precipitates inside grains.

6. Even in a composition system in which $M_6C$ carbides will not precipitate at grain boundaries, such precipitates as $M_{23}C_6$ carbides, $M_7C_3$ caribides and cementites precipitate along grain boundaries. These precipitates precipitate along grain boundaries in a film-like form in the early stage of precipitation and, therefore, around each of the above grain boundary precipitates, a zone free of other carbides such as MX type precipitates is formed, and the grain boundary strength becomes weak resulting in a reduction in creep rupture ductility or a deterioration in toughness. When, however, the film-like grain boundary precipitates change into spherical forms, carbide precipitate-free zones are recovered around the spherical grain boundary precipitates and the creep rupture ductility and toughness are recovered. Further, when $M_{23}C_6$ carbides, $M_7C_3$ caribides and cementites, which have changed into spherical forms, are uniformly present on the grain boundaries, the grain boundary sliding is prevented and the creep strength after a long period of use.

7. When V is dissolved in the grain boundary precipitates such as $M_{23}C_6$ carbides, $M_7C_3$ carbides or cementites, the coarsening of the above precipitates becomes difficult to occur, and the decrease in creep strength after a long period of use is suppressed.

8. When the amount of V among the metal elements constituting each grain boundary precipitate is not less than 2% by mass and the minor axis length-to-major axis length ratio (minor axis/major axis) is not less than 0.5, good creep strength, creep rupture ductility and toughness are obtained.

9. When the matrix of a low/medium Cr heat resistant steel is a bainite single phase structure, the MX type precipitates inside grains tend to be uniformly distributed and the grain boundary precipitates also tend to become spherical. Therefore, the strength at elevated temperatures is high and, in addition, a very high creep strength can be secured even on the high temperature and after a long period of use, and the toughness is also very good. This is because when the matrix structure is a bainite single phase structure, the density of MX type precipitates becomes higher as compared with the case where ferrite is present in the matrix structure and, in addition, it becomes difficult for plate-like or rod-like precipitates having a small "minor axis/major axis" value, which are observable at prior-austenite grain boundaries, ferrite-bainite interfaces or martensite-bainite interfaces, to precipitate as compared with the case where ferrite and martensite occur in admixture.

10. When, in a low/medium Cr heat resistant steel having a specific chemical composition, the contents of B, N, Cr, V, Nb and Ti satisfy the relations (3) to (5) given below, the matrix microstructure becomes a bainite single phase structure.

$$B-(N/3)\geqq 0 \quad (3)$$

$$(Cr/7)-V>0 \quad (4)$$

$$\log[(Cr/7)-V]\times\log(Nb+2Ti+0.001)\leqq 2 \quad (5)$$

The symbols for elements in the above formulas (3) to (5) represent the contents, on the % by mass basis, of the elements in the steel.

The present invention has been completed based on the above findings.

In the following, the respective elements of the invention are described in detail. The content "%" of each element means "% by mass".

(A) Chemical composition of the steel

C:

C forms MX type precipitates and $M_2X$ type precipitates with Cr, V, Mo and the like and is effective in increasing the strength at elevated temperatures and creep strength. At a C content below 0.01%, however, the amount of MX type precipitates and $M_2X$ type precipitates is insufficient and, further, the hardenability decreases and ferrite becomes easy to precipitate, hence the strength at elevated temperatures, creep strength and toughness are impaired. On the other hand, at a C content above 0.25%, MX type precipitates and $M_2X$ type precipitates and other carbides such as $M_6C$ carbides, $M_{23}C_6$ carbides, $M_7C_3$ carbides and cementites precipitate in excess and, therefore, the steel is markedly hardened, whereby the workability and weldability are sacrificed. Further, the martensite content in the microstructure increases, leading to decreases in creep strength on the long period side and in creep rupture ductility. Therefore, the C content has been restricted to 0.01–0.25%. The C content is preferably 0.02–0.15%, more preferably 0.06–0.08%.

Cr:

Cr is an element essential in securing the oxidation resistance and high temperature corrosion resistance. At a Cr content less than 0.5%, however, these effects cannot be obtained. On the other hand, at a Cr content exceeding 8%, the weldability and heat conductivity become low and the economical efficiency decreases and, therefore, the advantages of low/medium Cr heat resistant steels decrease. Therefore, the Cr content has been restricted to 0.5–8%. A preferred Cr content range is 0.7–5% and a more preferred range is 0.8–3%.

V:

V is an important element for forming MX type precipitates. Thus, V binds to C and N to form fine V(C,N) and is effective in increasing the creep strength and strength at elevated temperatures. However, at a V content below 0.05%, the amount of V(C,N) precipitates is small and thus will not contribute toward improvements in creep strength and strength at elevated temperatures. On the other hand, at a V content exceeding 0.5%, V(C,N) become coarse and ferrite tends to precipitate around the coarse V(C,N), thus rather impairing the creep strength, strength at elevated temperatures and toughness. Therefore, the V content has been restricted to 0.05–0.5%. The V content is preferably 0.06–0.3%, more preferably 0.08–0.25%. A V content of 0.08–0.12% is much more preferred.

Si:

Si serves as a deoxidizer and also increases the steam oxidation resistance of steels. However, when its content exceeds 0.7%, the toughness decreases markedly and it is also harmful to the creep strength. Therefore, the Si content should be not more than 0.7%. Although no lower limit is particularly given since the Si content may be at an impurity level, the Si content is desirably not less than 0.01%. A preferred Si content range is 0.1–0.6%, a more preferred range is 0.15–0.45% and a most preferred range is 0.15–0.35%.

Mn:

Mn has desulfurizing and deoxidizing effects and is an element effective in improving the hot workability of steels. Mn also is effective in increasing the hardenability of steels. However, at a Mn content above 1%, it impairs the stability of fine precipitates which are effective in creep strengthening and, in addition, part or the whole of the matrix becomes martensite according to the cooling conditions, hence the creep strength on the high temperature, after a long period of use. Therefore, the Mn content should be not more than 1%. While no lower limit is particularly given herein since the Mn content maybe at an impurity level, the Mn content is desirably not less than 0.01%. A preferred Mn content range is 0.05–0.65%, a more preferred range is 0.1–0.5% and a most preferred range is 0.3–0.5%.

The heat resistant steel of the present invention is required only to contain the above-mentioned C, Si, Mn, Cr and V as constituent elements other than Fe. However, it may contain, in addition to the above components, Mo, W, Nb, N, Ti, Ta, Cu, Ni, Co, B, Al, Ca, Mg and Nd selectively according to need. Namely, the elements Mo, W, Nb, N, Ti, Ta, Cu, Ni, Co, B, Al, Ca, Mg and Nd may be added as optional additive elements.

In the following, the above optional additive elements are described.

Mo, W:

These elements, when added, contribute to improvements in creep strength and strength at elevated temperatures through their solid-solution strengthening effect. They also form $M_2X$ type precipitates, hence improve the creep strength and strength at elevated temperatures by precipitation strengthening. These effects may be obtained at their impurity level contents. For obtaining more marked effects, however, a Mo content of not less than 0.01% or a W content of not less than 0.02% is preferred. However, at a Mo content exceeding 2.5% or a W content exceeding 5%, their effects reach a point of saturation and, in addition, the precipitation of ferrite is promoted and the weldability and toughness are rather impaired. Therefore, when these elements are added, it is recommendable that the content of Mo be 0.01–2.5% and that of W be 0.02–5%. For Mo, a preferred range is 0.02–2%, a more preferred range is 0.05–1.5%, and a range of 0.1–0.8% is still more preferred and a range of 0.3–0.6% is most preferred. A preferred W content range is 0.02–4% and a more preferred range is 0.05–3%. These elements may be used singly or both may be added in combination. When Mo and W are added combinedly to obtained the above effects markedly, the Mo (%)+0.5W (%) value is recommendably 0.01–2.5%.

Nb:

Like V, Nb, when added, forms MX type precipitates and thus improves the creep strength and strength at elevated temperatures through precipitation strengthening. It is also effective to suppress the coarsening of MX type precipitates and thus it increases the heat stability thereof and prevents the reduction in the creep strength after a long period of use. It is further effective in rendering grains fine and thus increasing the weldability and toughness and also effective in preventing the welding heat-affected zone (hereinafter referred to as HAZ) from softening. These effects may be obtained at its impurity level contents. For obtaining more marked effects, however, a Nb content of not less than 0.002% is preferred. At a Nb content above 0.2%, however, the steel hardens markedly and, in addition, MX type precipitates become rather coarse, whereby the creep strength, strength at elevated temperatures and toughness are impaired. Therefore, when it is added, the Nb content is desirably 0.002–0.2%. A preferred Nb content range is 0.005–0.1% and a more preferred range is 0.01–0.07%, and a range of 0.02–0.06% is still more preferred.

N, Ti, Ta, Cu, Ni, Co:

These elements, when added, are effective in increasing the creep strength and strength at elevated temperatures.

Thus, N binds to V, Nb, C and the like and forms fine precipitates inside grains and is thus effective in increasing the creep strength and strength at elevated temperatures. N is further effective in rendering grains fine and thus increasing the weldability and toughness and preventing the HAZ from softening. These effects of N may be obtained at its impurity level contents. For obtaining more marked effects, however, the N content is preferably not less than 0.001%. At an N content exceeding 0.1%, however, the precipitates rather become coarse, whereby the creep strength, strength at elevated temperatures and toughness are impaired. Further, the addition of excess N has the disadvantage that the precipitation of proeutectoid ferrite is promoted. Therefore, when it is added, the N content is desirably 0.001–0.1%. A preferred N content range of 0.002–0.05% and a more preferred range is 0.003–0.01%, and a range of 0.002–0.007% is still more preferred.

Ti and Ta, like V, form MX type precipitates and thus are effective in increasing the creep strength and strength at elevated temperatures through precipitation strengthening. Ti and Ta are further effective in rendering grains fine and thus increasing the weldability and toughness and preventing the HAZ from softening. These effects of Ti and Ta may be obtained at their impurity level contents. For obtaining more marked effects, however, the Ti content is preferably not less than 0.001% and the Ta content is preferably not less than 0.002%. At a Ti content above 0.1% or a Ta content above 0.2%, however, the steel hardens markedly, whereby the toughness, workability and weldability are impaired. Therefore, when Ti and/or Ta is added, the Ti content is desirably 0.001–0.1% and the Ta content is desirably 0.002–0.2%. A preferred Ti content range is 0.003–0.05% and a more preferred range is 0.005–0.015%, and a range of 0.005–0.01% is still more preferred. A preferred Ta content range is 0.005–0.1% and a more preferred range is 0.005–0.07%, and a range of 0.005–0.02% is still more preferred.

Cu, Ni and Co are austenite-forming elements and have solid solution strengthening effects, hence are effective in increasing the strength at elevated temperatures and creep strength. The above effects of Cu, Ni and Co may be obtained at their impurity level contents. For obtaining more marked effects, however, the content of each of them is preferably not less than 0.01%. For each of Cu, Ni and Co, however, a content exceeding 0.5% rather causes decreases in creep strength on the high temperature, after a long period of use. Excessive addition is undesirable from the economical point as well. Therefore, when Cu, Ni and/or Co is added, the content of each is desirably 0.01–0.5%. For each of Cu, Ni and Co, a preferred content range is 0.02–0.3% and a more preferred range is 0.1–0.2%. In addition to the effects mentioned above, Cu is effective in increasing the thermal conductivity and Ni is effective in increasing the toughness.

The above elements N, Ti, Ta, Cu, Ni and Co may be used singly or two or more of them may be added combinedly.

B:

B, when added, suppresses coarsening of precipitates and contributes to improvements in creep strength after a long period of use. Further, it is an element effective in increasing the hardenability and thus securing stable strength at elevated temperatures and creep strength. These effects may be obtained at its impurity level contents. For obtaining more marked effects, however, the B content is desirably not less than 0.0001%. At a B content exceeding 0.1%, however, B markedly segregates at grain boundaries to cause grain boundary precipitates rather to coarsen, whereby the strength at elevated temperatures, creep strength and toughness are impaired. Therefore, when it is added, the content of B is recommendably 0.0001–0.1%. A preferred B content range is 0.0005–0.015% and a more preferred range is 0.001–0.008%, and a range of 0.001–0.004% is still more preferred.

Al:

Al, when added, produces a deoxidizing effect. This effect may be obtained at its impurity level contents. For obtaining more marked effects, however, the Al content is desirably not less than 0.001%. At an Al content exceeding 0.05%, however, it impairs the creep strength after a long period of use and the workability. Therefore, when it is added, the content of Al is recommendably 0.001–0.05%. A preferred Al content range is 0.001–0.02% and a more preferred range is 0.002–0.015%. The term "Al content" as used herein means the content of acid-soluble Al (the so-called sol. Al).

Ca, Mg, Nd:

These elements, when added, each fixes S and is effective in increasing the toughness and preventing the creep embrittlement. These effects may be obtained at their impurity level contents. For obtaining more marked effects, however, the content of each of the elements is desirably not less than 0.0001%. For each element, at a content exceeding 0.01%, however, it causes increases in the amount of oxides and sulfides and rather impairs the toughness. Therefore, when they are added, the content of each of the elements is desirably 0.0001–0.01%. For each element, a preferred content range is 0.0002–0.005% and a more preferred range is 0.0005–0.0035%. These elements may be added singly or two or more of them may be added in combination.

P, S:

These elements are contained in steels as impurities and are harmful to the toughness, workability and weldability and, in particular, they promote the temper embrittlement. Therefore, it is desirable that their content be as low as possible. The content of P is preferably not more than 0.03% and that of S not more than 0.015%.

Relations or formulas (1) and (2):

When $M_6C$ carbides precipitate out at grain boundaries, the creep strength, strength at elevated temperatures and toughness decrease. It is therefore essential to suppress the M6C carbides precipitation.

As already mentioned hereinabove, the intensive investigations made by the present inventors have newly revealed that when the contents of C, Mn, Mo and W in a low/medium Cr heat resistant steel having such a chemical composition as mentioned above satisfy the relations given hereinabove, $M_6C$ carbides will not precipitate, and as a result, the amount of solute Mo and the amount of solute W can be secured, whereby the reduction in the creep strength after a long period of use can be suppressed. Therefore, it has been prescribed that the value of "$C-0.06\times(Mo+0.5W)$" should be not less than 0.01 and the value "$Mn+0.69\times\log(Mo+0.5W+0.01)$" should be not more than 0.60, namely that the relations (1) and (2) should be satisfied.

Relations or formulas (3), (4) and (5):

Further, as a result of the intensive investigations made by the present inventors, it has been revealed that when the contents of B, N, Cr, V, Nb and Ti in a low/medium Cr heat resistant steel having such a chemical composition as mentioned above satisfy the relations (3) to (5) given above, the matrix micro structure becomes a bainite single phase structure, the strength at elevated temperatures becomes high and a very high creep strength can be secured on the high temperature, after a long period of use as well and, furthermore, the toughness becomes very good. Therefore, in cases where a high strength at elevated temperatures and a high creep strength on the high temperature, creep strength after a long period of use are to be secured and where good toughness is required, it is desirable to prescribe that the value of "B−(N/3)" should be not less than 0 (zero), the value of "(Cr/7)−V" should be more than 0 and the value of "log[(Cr/7)−V]×log(Nb+2Ti+0.001)" should be not more than 2, namely the above relations (3) to (5) should be satisfied.

(B) Precipitates (B-1) Precipitates inside grains

When fine precipitates are present inside grains, they contribute to precipitation strengthening and, in particular when the density of occurrence of precipitates having an average diameter of not more than 30 nm is not less than $1/\mu m^3$, the precipitation strengthening effect is remarkable and it becomes possible to improve the strength at elevated temperatures and creep strength.

Thus, when the precipitates inside grains become coarse and their average diameter exceeds 30 nm, their precipitation strengthening effect falls. On the other hand, even when precipitates having an average diameter of not more than 30 nm are present inside grains, a sufficient level of precipitation strengthening effect cannot be obtained if the density of occurrence thereof is less than $1/\mu m^3$.

Therefore, as regards the precipitates inside grains, it has been prescribed according to the invention that the density of occurrence of precipitates having an average diameter of not more than 30 nm should be not less than $1/\mu m^3$.

As already mentioned hereinabove, the term "average diameter" as used herein specifically means the value defined as ½ of the sum of the minor axis length and major axis length. The precipitates having an average diameter of not more than 30 nm can be readily observed using a transmission electron microscope. In particular when an ultrahigh voltage transmission electron microscope is used, for example at an accelerating voltage of 3,000 kV, it is possible to observe the objects in the atomic level, the lower limit to the average diameter of the above precipitates maybe set at about 0.3 nm corresponding to the lattice constant of Fe or the precipitates. At an ordinary accelerating voltage (e.g. 100–200 kV), however, those having an average diameter of 2 nm or smaller are out of the resolving power of a transmission electron microscope and may not be distinctly identified. Therefore, it is practical to set the lower limit to the average diameter of the above precipitates at 2 nm.

On the other hand, when the density of precipitates having an average diameter of not more than 30 nm is higher, a higher level of precipitation strengthening effect is obtained. Therefore, the upper limit need not be set to the above-mentioned density. An actual upper limit is about $500/\mu m^3$, however.

The density of precipitates inside grains can be determined, for example, by converting the two-dimensional data observed by using a transmission electron microscope to the three-dimensional one, as explained in the Bulltein of the Japan Institute of Metals, vol. 10 (1971), pages 279–289.

Thus, several fields (e.g. 5 fields) are photographed at a high magnification using a transmission electron microscope. The three-dimensional density of precipitates inside grains can be determined from the number $N_A$ of precipitates having prescribed sizes per unit area ($1\ \mu m^2$) as determined from the photos and the value $N_L$ calculated by dividing the number of points of intersection of arbitrary straight lines drawn on the photos and the precipitates by the length ($\mu$m) of the lines.

Specifically, the density $N_V$ (number of precipitates/$\mu m^3$) of occurrence of precipitates as defined by the present invention can be determined, for example, by photographing 5 fields at a magnification of 40,000 using a transmission electron microscope at an accelerating voltage of 100 kV, determining the number $N_A$ of precipitates having an average diameter of 2–30 nm from the photos, calculating the value $N_L$ by dividing the number of points of intersection of arbitrary straight lines drawn on the photos and the precipitates by the length ($\mu$m) of the lines and carrying out a calculation according to the equation (6) given below on the assumption that the precipitates has a disk form:

$$N_V=2(N_A^2/\pi)N_L \tag{6}$$

In this case, there may of course be present precipitates having an average diameter exceeding 30 nm. The number thereof is desirably as small as possible, however.

It is desirable that the precipitates inside grains be coherent precipitates, since when the precipitates having an average diameter of not more than 30 nm and precipitating inside grains are coherent precipitates (namely MX type precipitates or $M_2X$ type precipitates), a more increased creep strength can be obtained.

As already mentioned hereinbefore, the term "coherent precipitates" as used herein includes not only precipitates in a state completely coherent with the matrix but also precipitates for which the interface between the matrix and the precipitate is partially coherent, with interface dislocations existing there.

Since coherent strains are found around the coherent precipitates, whether the precipitates are coherent precipitates or not can be judged by examining for the occurrence of coherent strains by observation using a transmission electron microscope. Specifically, when the direction of incident electron beams is selected so as to establish two-beam diffraction conditions at a high magnification of 20,000 or more using a transmission electron microscope, a contrast due to a coherent strain appears and the presence or absence of a coherent strain can be identified. Therefore, whether the precipitates are coherent ones or not can be judged.

(B-2) Grain boundary precipitates

As already mentioned, when $M_6C$ carbides precipitate out at grain boundaries, the creep strength and/or strength at elevated temperatures decreases. Therefore, it is essential to suppress the precipitation of $M_6C$ carbide. Thus, for not only increasing the creep strength and strength at elevated temperatures but also increasing the creep rupture ductility and toughness, it is preferable to consider the precipitates at grain boundaries besides $M_6C$ carbides as well as the precipitates inside grains.

Even in a component system in which $M_6C$ carbides will not precipitate at grain boundaries, precipitates such as $M_{23}C_6$ carbides, $M_7C_3$ carbides and/or cementites precipitates along grain boundaries and, when these grain boundary precipitates change to spherical in shape, the creep rupture ductility and toughness are recovered. When the value of the "minor axis/major axis", which is the ratio of the length of the minor axis and major axis of grain boundary precipitates is not less than 0.5, the creep rupture ductility and toughness are markedly recovered.

Further, while V is hardly soluble in $M_6C$ carbides or, in other words, V is hardly contained among metal elements M constituting $M_6C$ carbides, V is soluble in grain boundary precipitates other than $M_6C$ carbides, for example in $M_{23}C_6$ carbides, $M_7C_3$ carbides and cementites ($M_3C$ carbides), hence V is included among the metal elements M. And, as the amount of V in the above precipitates increases, the coarsening of precipitates becomes difficult to occur and the reduction in creep strength after a long period of use is prevented and, in particular when the amount of V among the metal elements M becomes more than 2%, the creep strength after a long period of use, the creep rupture ductility and the toughness become stabilized. Further, the temper embrittlement becomes difficult to occur.

Therefore, for increasing the creep strength after a long period of use, creep rupture ductility and toughness and rendering the temper embrittlement difficult to occur, it is desirable that the amount of V among metal elements constituting each grain boundary precipitate be not less than 2% by mass and that the ratio of minor axis to major axis (minor axis/major axis) thereof be not less than 0.5.

V tends to be soluble particularly in $M_{23}C_6$ carbides, $M_7C_3$ carbides and cementites among grain boundary precipitates including V among metal elements M. Therefore, it is desirable that at least one of $M_{23}C_6$ carbides, $M_7C_3$ carbides and cementites be present as grain boundary precipitates.

The upper limit to the content of V among metal elements constituting each grain boundary precipitate is not particularly specified herein. However, when the amount of V in each grain boundary precipitate is in excess, the amount of the above-mentioned MX type precipitates decreases. Therefore, the upper limit to the amount of V is preferably set at not more than 10%.

The amount of V occurring in grain boundary precipitates can be determined by energy dispersive X-ray analysis (EDX analysis) using a transmission electron microscope.

(C) Matrix microstructure

As for the microstructure of the matrix of the low/medium Cr heat resistant steel of the present invention, no particular prescriptions need be made. However, when the matrix microstructure contains ferrite, the strength at elevated temperatures, creep strength and toughness may lower in some instances and, when the matrix microstructure contains martensite, the creep strength may decrease after a long period of use in certain instances. On the contrary, when the matrix has a bainite single phase structure, the strength at elevated temperatures is high and a high level of creep strength can be secured even on the high temperature, after a long period of use, and the toughness is also good. Therefore, in cases where the strength at elevated temperature and creep strength after a long period of use are to be secured and good toughness is also required, it is desirable that the matrix microstructure be a bainite single phase one.

When the contents of B, N, Cr, V, Nb and Ti satisfy the above-mentioned relations (3) to (5), the matrix microstructure of the low/medium Cr heat resistant steel of the present invention becomes a bainite single phase structure.

The low/medium Cr heat resistant steel of the present invention may be a forging steel produced by melting, casting and hot working or a cast steel to be used as cast.

When a forging steel or cast steel whose material steel has the chemical composition mentioned above under (A) is subjected to the heat treatment steps mentioned below, it is relatively easy to cause the precipitates inside grains and grain boundary precipitates to have the predetermined respective sizes, densities, compositions and shapes.

(D) Heat treatment (D-1) Normalizing:

Normalizing is preferably carried out at a temperature which is not lower than the austenite transformation temperature and at which precipitates inside grains are dissolved and grain growth can not be occurred, and after normalizing, cooling is preferably carried out at a rate of cooling of not slower than 200° C./hour. Specifically, the normalizing temperature is preferably about 900–1,100° C., more preferably 920–1,050° C., although it may vary depending on the chemical composition of the material steel. The rate of cooling following normalizing is preferably as fast as possible but, from the practical viewpoint, the rate of cooling which corresponds to water quenching (namely a cooling rate of about 5° C./sec) or below is sufficient.

(D-2) Tempering:

It is preferably that tempering follows the above cooling after normalizing to make the desired precipitates to precipiate inside grains. Further, due to tempering, V can be soluble in grain boundary precipitates (namely, V partitions to metal elements constituting grain boundary precipitates). The tempering temperature is, for example, 550° C. to the AC1 transformation temperature, whereby satisfactory results are obtained. The tempering is preferably carried out in the temperature range of (AC1 transformation temperature—50° C.) to the AC1 transformation temperature.

As already mentioned, the low/medium heat resistant steel of the invention may be a forging steel or a cast steel. However, a large number of dislocations have been introduced into a forging steel which has been hot worked in a high temperature austenite zone and, therefore, the density of precipitates having an average diameter of not more than 30 nm and occurring inside grains generally increases more readily in a forging steel and the strength of the forging steel can more readily be increased, as compared with a cast steel, since the dislocations serve as nucleus forming sites for precipitation; hence forging steels are preferred. However, even for forging steels, for thoroughly utilizing the effects of hot working, heating in the temperature range from the AC3 transformation temperature to 1,300° C. is preferably followed by hot working at a rolling reduction of not less than 50%. This is because when the heating temperature and rolling reduction are within the above ranges, sufficient effects of hot working can be produced. Further, when hot working is directly followed by normalizing, the production cost can be reduced as a result of energy saving.

The following examples illustrate the present invention in more detail.

EXAMPLES

Thirty-eight steel species having the respective chemical compositions shown in Tables 1 to 4 were melted and the ingots of the respective steels as obtained, except for the ingots of steels C and K, were heated to a temperature of 1,000–1,200° C. and hot rolled at a rolling reduction of 50–70% to give 50-mm-thick plates. The ingots of steels C and K were directly subjected to machining to give 50-mm-thick plates.

In Tables 1 to 4, steels A to V, steel 12, steel 13 and steel 16 are steels whose components satisfy the requirements posed by the present invention whereas steels 1 to 11, steel 14 and steel 15 in Tables 3 and 4 are steels one component of which fails to satisfy the conditions prescribed by the present invention.

TABLE 1

| | Chemical composition (% by mass) Balance: Fe and impurities | | | | | | | | | | | | | |
|---|---|---|---|---|---|---|---|---|---|---|---|---|---|---|
| Steel | C | Si | Mn | P | S | Cr | V | Nb | Mo | N | B | Ti | Ta | Ni |
| A | 0.06 | 0.25 | 0.50 | 0.011 | 0.002 | 1.24 | 0.11 | 0.040 | 0.38 | 0.0072 | 0.0025 | 0.006 | — | 0.15 |
| B | 0.07 | 0.25 | 0.35 | 0.012 | 0.002 | 2.25 | 0.25 | 0.050 | 0.12 | 0.0046 | 0.0030 | — | — | — |
| C | 0.15 | 0.17 | 0.80 | 0.008 | 0.002 | 0.80 | 0.05 | 0.030 | 0.25 | 0.0053 | 0.0025 | 0.005 | — | — |
| D | 0.07 | 0.31 | 0.25 | 0.012 | 0.001 | 1.15 | 0.17 | 0.050 | 0.48 | 0.0060 | 0.0021 | — | — | — |
| E | 0.10 | 0.24 | 0.35 | 0.009 | 0.002 | 2.10 | 0.15 | 0.010 | 0.55 | 0.0065 | 0.0024 | 0.008 | — | 0.10 |
| F | 0.08 | 0.22 | 0.43 | 0.013 | 0.002 | 1.50 | 0.05 | 0.100 | 0.78 | 0.0054 | 0.0034 | — | 0.01 | 0.10 |
| G | 0.21 | 0.27 | 0.23 | 0.008 | 0.002 | 0.82 | 0.10 | 0.053 | 0.31 | 0.0059 | 0.0010 | — | — | — |
| H | 0.10 | 0.25 | 0.02 | 0.008 | 0.002 | 2.26 | 0.25 | 0.062 | 0.08 | 0.0043 | 0.0040 | 0.010 | — | 0.02 |
| I | 0.06 | 0.17 | 0.50 | 0.012 | 0.002 | 2.34 | 0.22 | 0.025 | 0.02 | 0.0088 | 0.0060 | — | — | — |
| J | 0.07 | 0.25 | 0.48 | 0.013 | 0.001 | 1.25 | 0.10 | 0.050 | 0.43 | 0.0086 | 0.0040 | — | — | 0.12 |
| K | 0.07 | 0.22 | 0.35 | 0.013 | 0.001 | 1.25 | 0.10 | — | 0.50 | 0.0073 | 0.0035 | 0.010 | — | 0.15 |
| L | 0.07 | 0.25 | 0.28 | 0.011 | 0.002 | 2.24 | 0.23 | — | 0.09 | 0.0083 | 0.0045 | 0.010 | — | — |
| M | 0.08 | 0.24 | 0.85 | 0.012 | 0.003 | 1.25 | 0.17 | 0.050 | — | 0.0057 | 0.0040 | 0.030 | — | — |
| N | 0.11 | 0.17 | 0.51 | 0.013 | 0.002 | 6.50 | 0.21 | 0.050 | — | 0.0067 | 0.0035 | — | — | 0.20 |
| O | 0.12 | 0.35 | 0.62 | 0.009 | 0.002 | 1.24 | 0.10 | 0.040 | 0.65 | 0.0043 | 0.0043 | — | 0.01 | 0.25 |
| P | 0.10 | 0.31 | 0.60 | 0.014 | 0.001 | 2.26 | 0.25 | 0.060 | 0.20 | 0.0064 | 0.0025 | — | — | — |
| Q | 0.12 | 0.35 | 0.95 | 0.012 | 0.002 | 1.25 | 0.25 | 0.050 | — | 0.0008 | — | — | — | — |
| R | 0.15 | 0.27 | 0.50 | 0.013 | 0.003 | 7.00 | 0.35 | 0.050 | — | 0.0005 | — | — | — | — |
| S | 0.12 | 0.51 | 0.55 | 0.012 | 0.001 | 2.25 | 0.21 | — | 0.05 | 0.0072 | — | — | — | — |
| T | 0.08 | 0.55 | 0.35 | 0.013 | 0.001 | 2.25 | 0.25 | 0.010 | 0.11 | 0.0087 | 0.0020 | — | — | — |
| U | 0.09 | 0.25 | 0.60 | 0.010 | 0.002 | 2.56 | 0.23 | — | 0.08 | 0.0004 | 0.0020 | 0.010 | — | — |
| V | 0.10 | 0.28 | 0.82 | 0.011 | 0.001 | 1.25 | 0.15 | — | — | 0.0002 | — | — | — | — |

TABLE 2

(continued from Table 1)

| | Chemical composition (% by mass) Balance: Fe and impurities | | | | | | | | | | | |
|---|---|---|---|---|---|---|---|---|---|---|---|---|
| steel | Cu | Co | W | Al | Ca | Mg | Nd | fn1 | fn2 | fn3 | fn4 | fn5 |
| A | 0.15 | — | — | 0.0025 | 0.0025 | — | — | 0.037 | 0.218 | 0.0001 | 0.067 | 1.496 |
| B | — | — | 1.55 | 0.0039 | 0.0010 | — | — | 0.016 | 0.320 | 0.0015 | 0.071 | 1.481 |
| C | 0.10 | — | — | — | — | 0.0025 | — | 0.135 | 0.396 | 0.0007 | 0.064 | 1.653 |
| D | — | — | — | 0.0002 | — | — | — | 0.041 | 0.036 | 0.0001 | −0.006 | — |
| E | — | 0.10 | — | 0.0015 | — | — | 0.001 | 0.067 | 0.176 | 0.0002 | 0.150 | 1.292 |
| F | 0.10 | — | — | 0.0014 | 0.0030 | — | — | 0.033 | 0.359 | 0.0016 | 0.164 | 0.781 |
| G | — | — | 0.05 | 0.0094 | 0.0021 | — | — | 0.190 | −0.089 | −0.0010 | 0.017 | 2.238 |
| H | — | — | 1.63 | 0.0072 | — | — | — | 0.046 | −0.010 | 0.0026 | 0.073 | 1.230 |
| I | 0.05 | — | 0.05 | 0.0059 | — | 0.0018 | — | 0.057 | −0.369 | 0.0030 | 0.114 | 1.493 |
| J | 0.11 | — | — | 0.0025 | 0.0015 | — | 0.003 | 0.044 | 0.234 | 0.0011 | 0.079 | 1.428 |
| K | 0.15 | — | — | 0.0029 | 0.0023 | — | — | 0.040 | 0.148 | 0.0011 | 0.079 | 1.854 |
| L | — | — | 1.63 | 0.0025 | 0.0025 | — | — | 0.016 | 0.253 | 0.0017 | 0.090 | 1.755 |
| M | — | — | — | 0.0029 | 0.0023 | — | — | 0.080 | −0.530 | 0.0021 | 0.009 | 1.973 |
| N | 0.20 | — | — | 0.0024 | 0.0016 | — | — | 0.110 | −0.870 | 0.0013 | 0.719 | 0.186 |
| O | 0.25 | 0.10 | 0.50 | 0.0034 | — | — | — | 0.066 | 0.592 | 0.0029 | 0.077 | 1.544 |
| P | — | — | 1.50 | 0.0052 | — | — | — | 0.043 | 0.588 | 0.0004 | 0.073 | 1.382 |
| Q | — | — | — | 0.0002 | — | — | — | 0.120 | −0.430 | −0.0003 | −0.071 | — |
| R | — | — | — | 0.0037 | — | — | — | 0.150 | −0.880 | −0.0002 | 0.650 | 0.242 |
| S | — | — | 1.85 | 0.0002 | — | — | — | 0.062 | 0.545 | −0.0024 | 0.111 | 2.859 |
| T | — | — | 1.94 | 0.0003 | — | — | — | 0.015 | 0.376 | −0.0009 | 0.071 | 2.245 |
| U | — | — | 1.60 | 0.0028 | — | — | — | 0.037 | 0.565 | 0.0019 | 0.136 | 1.455 |
| V | — | — | — | — | — | — | — | 0.100 | −0.560 | −0.0001 | 0.029 | 4.632 |

fn1 = C − 0.06 × (Mo + 0.5W),
fn2 = Mn + 0.69 × log(Mo + 0.5W + 0.01)
fn3 = B − (N/3),
fn4 = (Cr/7) − V,
fn5 = log{(Cr/7) − V} × log(Nb + 2Ti + 0.001)
"—" in the fn5 column indicates that the basic law of logarithm, namely "the antilogarithm should be positive", is violated.

TABLE 3

| | Chemical composition (% by mass) Balance: Fe and impurities | | | | | | | | | | | | | |
|---|---|---|---|---|---|---|---|---|---|---|---|---|---|---|
| Steel | C | Si | Mn | P | S | Cr | V | Nb | Mo | N | B | Ti | Ta | Ni |
| 1 | 0.14 | 0.25 | 0.45 | 0.015 | 0.004 | 1.01 | — | — | 0.35 | 0.0101 | — | — | — | 0.05 |
| 2 | 0.10 | 0.30 | 0.45 | 0.010 | 0.002 | 2.25 | — | — | 0.98 | 0.0124 | — | — | — | — |
| 3 | 0.06 | 0.75 | 0.35 | 0.012 | 0.002 | 1.35 | 0.15 | 0.020 | 0.65 | 0.0048 | 0.0032 | 0.005 | — | — |
| 4 | 0.07 | 0.35 | 1.85 | 0.011 | 0.003 | 1.23 | 0.11 | 0.050 | 0.58 | 0.0061 | 0.0045 | — | — | — |

TABLE 3-continued

| Steel | Chemical composition (% by mass) Balance: Fe and impurities | | | | | | | | | | | | | |
|---|---|---|---|---|---|---|---|---|---|---|---|---|---|---|
| | C | Si | Mn | P | S | Cr | V | Nb | Mo | N | B | Ti | Ta | Ni |
| 5 | 0.08 | 0.26 | 0.55 | 0.012 | 0.002 | 0.31 | 0.07 | 0.020 | 0.25 | 0.0032 | 0.0026 | — | — | — |
| 6 | 0.30 | 0.25 | 0.35 | 0.011 | 0.002 | 1.28 | 0.65 | 0.050 | 0.51 | 0.0040 | 0.0035 | — | — | — |
| 7 | 0.07 | 0.26 | 0.35 | 0.012 | 0.002 | 1.82 | 0.02 | 0.002 | 3.05 | 0.0042 | 0.0021 | — | — | — |
| 8 | 0.14 | 0.75 | 1.49 | 0.009 | 0.005 | 0.52 | 0.17 | 0.012 | 0.52 | 0.0051 | 0.0012 | — | — | — |
| 9 | 0.26 | 0.25 | 0.50 | 0.003 | 0.001 | — | 1.01 | — | 0.53 | 0.0025 | — | — | — | — |
| 10 | 0.002 | 0.08 | 0.51 | 0.002 | 0.001 | — | 0.48 | — | 0.30 | 0.0022 | 0.30 | 0.70 | — | — |
| 11 | 0.15 | 0.03 | 1.35 | 0.005 | 0.001 | — | — | 0.050 | — | 0.0035 | — | — | — | — |
| 12 | 0.14 | 0.24 | 0.36 | 0.011 | 0.003 | 5.50 | 0.22 | 0.050 | 1.50 | 0.0052 | 0.0031 | 0.010 | — | — |
| 13 | 0.10 | 0.25 | 0.51 | 0.014 | 0.001 | 6.50 | 0.09 | 0.030 | 1.25 | 0.0079 | 0.0030 | 0.005 | — | 0.10 |
| 14 | 0.15 | 0.23 | 0.80 | 0.012 | 0.002 | 1.23 | 0.11 | 0.040 | 0.55 | 0.0063 | 0.0025 | — | 0.01 | — |
| 15 | 0.06 | 0.35 | 0.85 | 0.012 | 0.002 | 2.25 | 0.05 | 0.010 | 1.00 | 0.0053 | 0.0005 | — | — | — |
| 16 | 0.09 | 0.28 | 0.50 | 0.011 | 0.002 | 1.40 | 0.08 | 0.030 | 1.06 | 0.0047 | 0.0008 | — | — | — |

TABLE 4

(continued from Table 3)

| Steel | Chemical composition (% by mass) Balance: Fe and impurities | | | | | | | | | | | |
|---|---|---|---|---|---|---|---|---|---|---|---|---|
| | Cu | Co | W | Al | Ca | Mg | Nd | fn1 | fn2 | fn3 | fn4 | fn5 |
| 1 | 0.05 | — | — | 0.0045 | — | — | — | 0.119 | 0.144 | −0.0034 | 0.321 | 2.522 |
| 2 | — | — | — | 0.0037 | — | — | — | 0.041 | 0.447 | −0.0041 | 0.144 | 1.479 |
| 3 | — | — | — | 0.0027 | — | — | — | 0.021 | 0.225 | 0.0016 | 0.043 | 2.064 |
| 4 | — | — | — | 0.0005 | — | 0.0010 | — | 0.035 | 1.692 | 0.0025 | 0.066 | 1.528 |
| 5 | — | — | 0.01 | 0.0013 | — | — | — | 0.065 | 0.152 | 0.0015 | −0.026 | — |
| 6 | — | 0.01 | — | 0.0021 | — | — | — | 0.269 | 0.154 | 0.0022 | −0.467 | — |
| 7 | — | — | — | 0.0004 | — | — | — | −0.113 | 0.685 | 0.0007 | 0.240 | 1.564 |
| 8 | — | — | — | 0.0066 | — | — | — | 0.109 | 1.300 | −0.0005 | −0.096 | — |
| 9 | — | — | — | 0.0026 | — | — | — | 0.228 | 0.315 | −0.0008 | −1.010 | — |
| 10 | — | — | — | 0.0024 | — | — | — | −0.016 | 0.159 | 0.2993 | −0.480 | — |
| 11 | — | — | 5.30 | 0.0027 | — | — | — | −0.009 | 1.643 | −0.0012 | 0 | — |
| 12 | — | — | 1.30 | 0.0016 | 0.0010 | — | — | 0.011 | 0.591 | 0.0014 | 0.566 | 0.284 |
| 13 | — | — | 0.15 | 0.0035 | — | — | — | 0.021 | 0.597 | 0.0004 | 0.839 | 0.106 |
| 14 | — | 0.10 | — | 0.0022 | 0.0020 | — | — | 0.117 | 0.626 | 0.0004 | 0.066 | 1.640 |
| 15 | — | — | 0.75 | 0.0025 | — | — | — | −0.023 | 0.948 | −0.0013 | 0.271 | 1.109 |
| 16 | — | — | 0.50 | 0.0021 | — | — | — | 0.011 | 0.583 | −0.0008 | 0.120 | 1.389 |

fn1 = C − 0.06 × (Mo + 0.5W),
fn2 = Mn + 0.69 × log(Mo + 0.5W + 0.01)
fn3 = B − (N/3),
fn4 = (Cr/7) − V,
fn5 = log{(Cr/7) − V} × log(Nb + 2Ti + 0.001)
"—" in the fn5 column indicates that the basic law of logarithm, namely "the antilogarithm should be positive", is violated.

Then, the plates obtained were subjected to heat treatment comprising normalizing and tempering under the conditions shown in Table 5. The tempering conditions are given in terms of the parameter $P_{LM}$ value. After normalizing, other steels than steel K and steel 8 were air-cooled and the steel K and steel 8 were water-quenched.

TABLE 5

| Steel | Normalising Temperature (° C.) | Tempering Parameter $P_{LM}$ | Microstructure of the matrix |
|---|---|---|---|
| A | 930 | 20300 | B |
| B | 1050 | 20900 | B |
| C | 930 | 19900 | B |
| D | 930 | 20300 | B + F |
| E | 920 | 20500 | B |
| F | 920 | 20300 | B |
| G | 950 | 21000 | B + F |
| H | 1100 | 20900 | B |
| I | 1050 | 20900 | B |
| J | 1050 | 20900 | B |
| K | 950 | 20500 | B |
| L | 950 | 20500 | B |

TABLE 5-continued

| Steel | Normalising Temperature (° C.) | Tempering Parameter $P_{LM}$ | Microstructure of the matrix |
|---|---|---|---|
| M | 950 | 20500 | B |
| N | 1050 | 20500 | B |
| 0 | 1050 | 20500 | B |
| P | 1050 | 20900 | B |
| Q | 950 | 20500 | B + F |
| R | 1050 | 20500 | B + F |
| S | 950 | 20500 | B + F |
| T | 1050 | 20900 | B + F |
| U | 950 | 20500 | B |
| V | 920 | 19900 | B + F |
| * 1 | 920 | 20300 | B + F |
| * 2 | 920 | 20300 | B + F |
| * 3 | 1050 | 20300 | B |
| * 4 | 930 | 20300 | B |
| * 5 | 950 | 19900 | B + F |
| * 6 | 950 | 19900 | B + F |
| * 7 | 930 | 20300 | B + F |
| * 8 | 1050 | 19900 | M |
| * 9 | 950 | 20500 | M + F |

TABLE 5-continued

| Steel | Normalising Temperature (° C.) | Tempering Parameter $P_{LM}$ | Microstructure of the matrix |
|---|---|---|---|
| *10 | 950 | 20500 | F |
| *11 | 950 | 20500 | B + F |
| 12 | 1050 | 21050 | B |
| 13 | 1050 | 21050 | B |
| *14 | 950 | 21050 | B |
| *15 | 960 | 18700 | B + F |
| 16 | 960 | 18700 | B + F |

$P_{LM}$ _ (T + 273) × (log t + 20). In this formula, T denotes tempering temperature (0C), and t denotes tempering time (h).
In the "Microstructure of the matrix" column, B denotes bainite, F denotes ferrite, and M denotes martensite,
Symbol * indicates falling outside the conditions specified by the present invention.

Test specimens were taken from each plate after the above heat treatment, the specimens were electro-polished and the resulting thin films were examined using a transmission electron microscope (accelerating voltage 200 kV) in order to estimate the size, density and shape of precipitates. The face of the tissue observation was the "longitudinal section" (the so-called "L section") of each plate. For the plates produced by hot rolling, the direction of rolling was the longitudinal direction of the plates. For the plates made by direct machining, the direction of ingot casting employed was taken as the longitudinal direction of the plates.

The density of precipitates having an average diameter of not more than 30 nm was determined by taking photos of 5 fields at a magnification of 40,000 and converting the two-dimentional data obtained from the photos to the three-dimensional data according to the formula (6).

The coherent precipitates were identified based on the presence or absence of a contrast due to coherent strain as observed by the two-beam diffraction method using a transmission electron microscope. The average diameter and particle density of the precipitates were measured in a condition where the electron beams is perpendicular to the {001} face of the matrix. As a result of observation, it was confirmed that the precipitates all had a true circle disk-like form and that the major axis=the minor axis.

The amount of V in grain boundary precipitates was determined by EDX analysis of the precipitates observed under the transmission electron microscope.

As for the strength at elevated temperatures, test specimens having a diameter of 6 mm and a parallel portion length of 30 mm were prepared and subjected to tensile testing at 500° C. and 550° C. by the conventional method, and the tensile strength was measured.

In creep testing, test specimens having a diameter of 6 mm and a parallel portion length of 30 mm were prepared and tested at 500° C. and 550° C. for maximum 10,000 hours, and the average creep rupture strength for 500° C.×8,000 hours was determined by interpolation.

Further, the rate of reduction in strength due to long time creep was quantitated by considering in terms of the ratio of 10,000-hour rupture strength to 100-hour rupture strength for each temperature.

In the Charpy impact test, 2 mm V-notched Charpy specimens as prescribed in JIS Z 2202 and having a width of 10 mm, a thickness of 10 mm and a length of 55 mm were used and the ductile-brittle transition temperature (° C.) was determined.

The results obtained in the above manner are shown in Tables 6 and 7.

TABLE 6

| Steel | Density of precipitates having an average diameter of not more than 30 nm (/μm³) | Density of coherent precipitates having an average diameter of not more than 30 nm (/μm³) | Grain boundary precipitates axis ratio | Grain boundary precipitates V among metal elements (mass %) | Tensile strength at elevated temperature (MP a) 500° C. | Tensile strength at elevated temperature (MP a) 550° C. | 500° C. × 8000 h average creep strength (MP a) | 10000 h/100 h creep strength ratio 500° C. | 10000 h/100 h creep strength ratio 550° C. | Charpy transition temperature (° C.) |
|---|---|---|---|---|---|---|---|---|---|---|
| A | 39 | 39 | 0.80 | 2.5 | 485 | 415 | 295 | 0.71 | 0.63 | −43 |
| B | 53 | 53 | 0.80 | 2.8 | 502 | 438 | 305 | 0.75 | 0.66 | −42 |
| C | 30 | 30 | 0.70 | 2.2 | 471 | 403 | 288 | 0.65 | 0.53 | −25 |
| D | 12 | 12 | 0.70 | 3.0 | 435 | 375 | 265 | 0.71 | 0.58 | −5 |
| E | 44 | 44 | 0.70 | 2.8 | 471 | 412 | 299 | 0.72 | 0.62 | −24 |
| F | 33 | 33 | 0.60 | 2.3 | 479 | 420 | 290 | 0.67 | 0.59 | −29 |
| G | 14 | 14 | 0.60 | 2.3 | 422 | 365 | 268 | 0.63 | 0.51 | −15 |
| H | 50 | 50 | 0.70 | 2.6 | 520 | 443 | 303 | 0.67 | 0.52 | −39 |
| I | 35 | 35 | 0.70 | 2.8 | 496 | 423 | 292 | 0.71 | 0.56 | −41 |
| J | 20 | 20 | 0.70 | 2.7 | 480 | 412 | 285 | 0.64 | 0.52 | −25 |
| K | 28 | 28 | 0.70 | 3.1 | 468 | 393 | 286 | 0.72 | 0.61 | −13 |
| L | 35 | 35 | 0.80 | 3.5 | 470 | 400 | 290 | 0.65 | 0.52 | −12 |
| M | 19 | 19 | 0.80 | 2.8 | 472 | 398 | 275 | 0.68 | 0.51 | −15 |
| N | 21 | 21 | 0.55 | 3.5 | 465 | 389 | 277 | 0.63 | 0.53 | −20 |
| O | 43 | 43 | 0.60 | 2.8 | 512 | 435 | 298 | 0.76 | 0.68 | −48 |
| P | 45 | 45 | 0.65 | 2.5 | 479 | 418 | 300 | 0.60 | 0.51 | −15 |
| Q | 15 | 7 | 0.70 | 2.7 | 418 | 368 | 250 | 0.61 | 0.53 | −8 |
| R | 12 | 8 | 0.65 | 3.0 | 435 | 427 | 255 | 0.65 | 0.55 | −7 |
| S | 17 | 7 | 0.35 | 2.2 | 435 | 377 | 253 | 0.58 | 0.51 | −6 |
| T | 25 | 20 | 0.55 | 2.4 | 445 | 380 | 277 | 0.72 | 0.55 | −10 |
| U | 18 | 10 | 0.60 | 1.5 | 428 | 370 | 260 | 0.70 | 0.53 | −8 |
| V | 14 | 10 | 0.35 | 2.3 | 425 | 367 | 250 | 0.66 | 0.52 | −9 |

In the grain boundary precipitates column, "axis ratio" means (minor axis length)/(major axis length).

TABLE 7

| Steel | Density of precipitates having an average diameter of not more than 30 nm (/μm³) | Density of coherent precipitates having an average diameter of not more than 30 nm (/μm³) | Grain boundary precipitates axis ratio | Grain boundary precipitates V among metal elements (mass %) | Tensile strength at elevated temperature (MPa) 500° C. | Tensile strength at elevated temperature (MPa) 550° C. | 500° C. × 800 h average creep strength (MPa) | 10000 h/100 h creep strength ratio 500° C. | 10000 h/100 h creep strength ratio 550° C. | Charpy transition temperature (° C.) |
|---|---|---|---|---|---|---|---|---|---|---|
| *1 | *— | — | 0.2 | — | 367 | 267 | 219 | 0.48 | 0.38 | 20 |
| *2 | *— | — | 0.15 | — | 381 | 285 | 225 | 0.51 | 0.43 | 5 |
| *3 | 2 | 0.5 | 0.2 | 0.8 | 395 | 305 | 235 | 0.53 | 0.41 | 13 |
| *4 | 23 | 2 | 0.1 | 0.05 | 465 | 398 | 240 | 0.68 | 0.46 | −2 |
| *5 | *0.5 | — | 0.4 | 1.0 | 322 | 189 | 211 | 0.52 | 0.42 | 18 |
| *6 | 2 | 2 | 0.2 | 3.5 | 500 | 356 | 237 | 0.65 | 0.41 | 15 |
| *7 | 15 | 2 | 0.3 | 0.1 | 348 | 246 | 236 | 0.58 | 0.45 | 16 |
| *8 | 30 | 0.05 | 0.25 | 0.8 | 487 | 260 | 208 | 0.51 | 0.39 | 0 |
| *9 | *0.5 | 0.5 | 0.15 | — | 535 | 452 | 221 | 0.35 | 0.28 | 35 |
| *10 | 2 | — | 0.1 | — | 420 | 388 | 234 | 0.41 | 0.28 | 41 |
| *11 | *— | — | 0.3 | 4.0 | 508 | 424 | 227 | 0.39 | 0.25 | 10 |
| 12 | *0.1 | — | 0.25 | — | 486 | 393 | 231 | 0.43 | 0.31 | 25 |
| 13 | *0.2 | — | 0.3 | — | 473 | 403 | 228 | 0.42 | 0.28 | 12 |
| *14 | 12 | 0.1 | 0.4 | — | 475 | 383 | 213 | 0.45 | 0.34 | 18 |
| *15 | *0.5 | — | 0.15 | — | 471 | 401 | 229 | 0.37 | 0.25 | 25 |
| 16 | *0.5 | — | 0.1 | — | 482 | 413 | 225 | 0.39 | 0.26 | 15 |

In the density of precipitates column, "—" means that there were no precipitates having a prescribed size.
In the grain boundary precipitates column, "axis ratio" means (minor axis length)/(major axis length), and in the V among metal elements column, "—" means that V was not detected.
Symbol * indicates falling outside the conditions specified by the present invention.

As is evident from Tables 6 and 7, steels A to V satisfying the requirement posed by the present invention concerning the density of particle of precipitates having an average diameter of not more than 30 nm and occurring inside grains each has high strength at elevated temperatures and creep property and further has good toughness. It is also evident that, among the steels mentioned above, steel A to R and steel T whose grain boundary precipitates satisfy the requirements posed by the present invention have better characteristics. It is further evident that steels A to C, steel E, steel F and steels H to P the components of which satisfy the above-mentioned relations established by the present invention and whose matrix has a bainite single phase structure have still better characteristics.

On the contrary, steels 1 to 11, steel 14 and steel 15 one component of which fails to meet the relevant requirement prescribed by the present invention are inferior to the steels of the present invention in at least one of the following characteristics: strength at elevated temperatures, creep property and toughness.

On the other hand, steel 12, steel 13 and steel 16 whose constituents satisfy the conditions imposed by the present invention but for which the density of particle of precipitates having an average diameter of not more than 30 nm fails to meet the requirement imposed by the present invention are inferior in strength at elevated temperatures and creep strength to the steels of the present invention.

INDUSTRIAL APPLICABILITY

The heat resistant steel of the present invention retains a high level of creep rupture strength at elevated temperatures not lower than 400° C., in particular in the temperature range of about 400–600° C., and, even after a long period of use in such a temperature range, it shows stable strength at elevated temperatures. Further, it is excellent in toughness. Therefore, it can be used in the field of applications such as heat exchangers, steel pipes for piping, heat resistant valves and members or parts requiring welding. Further, the heat resistant steel of the present invention has excellent properties as mentioned above and, therefore, can be use in those filed where high Cr steels having increased alloying element contents alone have been considered usable; thus, the economical effect thereof is significant.

What is claimed is:

1. A heat resistant steel which comprises, by mass %, C: 0.01–0.25%, Cr: 0.5–8%, V: 0.05–0.5%, Si: not more than 0.7%, Mn: not more than 1%, Mo: not more than 2.5%, W: not more than 5%, Nb: not more than 0.2%, N: not more than 0.1%, Ti: not more than 0.1%, Ta: not more than 0.2%, Cu: not more than 0.5%, Ni: not more than 0.5%, Co: not more than 0.5%, B: not more than 0.1%, Al: not more than 0.05%, Ca: not more than 0.01%, Mg: not more than 0.01%, Nd: not more than 0.01%, with Fe and impurities accounting for the balance, the chemical composition of which satisfies the relations (1) and (2) given below and in which, among precipitates inside grains, precipitates having an average diameter of not more than 30 nm are present at a density of not less than 1/μm³:

$$C-0.06\times(Mo+0.5\ W)\geqq 0.01 \quad (1),$$

$$Mn+0.69\times\log(Mo+0.5\ W+0.01)\leqq 0.60 \quad (2),$$

wherein, in the above formulas (1) and (2), the symbols for elements represent the contents, on the % by mass basis, of the elements in the steel.

2. The heat resistant steel according to claim 1, wherein the amount of V among the metal elements constituting each grain boundary precipitate is not less than 2% by mass and the value of the ratio between the length of the minor axis and major axis "minor axis/major axis" thereof is not less than 0.5.

3. The heat resistant steel according to claim 1, wherein the chemical composition further satisfies the following relations (3) to (5):

$$B-(N/3)\geqq 0 \quad (3),$$

$$(Cr/7)-V>0 \quad (4),$$

$$\log[(Cr/7)-V]\times\log(Nb+2Ti+0.001)\leqq 2 \quad (5),$$

wherein, in the above formulas (3) to (5), the symbols for elements represent the contents, on the % by mass basis, of the elements in the steel.

4. The heat resistant steel according to claim 2, wherein the chemical composition further satisfies the following relations (3) to (5):

$$B-(N/3)\geqq 0 \quad (3),$$

$$(Cr/7)-V>0 \quad (4),$$

$$\log[(Cr/7)-V]\times\log(Nb+2Ti+0.001)\leqq 2 \quad (5),$$

wherein, in the above formulas (3) to (5), the symbols for elements represent the contents, on the % by mass basis, of the elements in the steel.

5. The heat resistant steel according to claims 2, wherein the contents of Mo and W give a value of Mo (%)+0.5W(%) of 0.01–2.5% and the content of Nb is 0.002–0.2%.

6. The heat resistant steel according to claims 3, wherein the contents of Mo and W give a value of Mo (%)+0.5W(%) of 0.01–2.5% and the content of Nb is 0.002–0.2%.

7. The heat resistant steel according to claims 4, wherein the contents of Mo and W give a value of Mo (%)+0.5W(%) of 0.01–2.5% and the content of Nb is 0.002–0.2%.

8. The heat resistant steel according to claim 4, wherein at least one of the following content requirements is satisfied: the N content of 0.001–0.1%, the Ti content of 0.001–0.1%, the Ta content of 0.002–0.2%, the Cu content of 0.01–0.5%, the Ni content of 0.01–0.5% and the Co content of 0.01–0.5%.

9. The heat resistant steel according to claim 4, wherein the content of B is 0.0001–0.1%.

10. The heat resistant steel according to claim 4, wherein the content of Al is 0.001–0.05%.

11. The heat resistant steel according to claim 4, wherein at least one of the following content requirements is satisfied: the Ca content of 0.0001–0.01%, the Mg content of 0.0001–0.01% and the Nd content of 0.0001–0.01%.

12. The heat resistant steel according to claim 7, wherein at least one of the following content requirements is satisfied: the N content of 0.001–0.1%, the Ti content of 0.001–0.1%, the Ta content of 0.002–0.2%, the Cu content of 0.01–0.5%, the Ni content of 0.01–0.5% and the Co content of 0.01–0.5%.

13. The heat resistant steel according to claim 7, wherein the content of B is 0.0001–0.1%.

14. The heat resistant steel according to claim 7, wherein the content of Al is 0.001–0.05%.

15. The heat resistant steel according to claim 7, wherein at least one of the following content requirements is satisfied: the Ca content of 0.0001–0.01%, the Mg content of 0.0001–0.01% and the Nd content of 0.0001–0.01%.

16. The heat resistant steel according to claims 7, wherein at least one of the following content requirements is satisfied: the N content of 0.001–0.1%, the Ti content of 0.001–0.1%, the Ta content of 0.002–0.2%, the Cu content of 0.01–0.5%, the Ni content of 0.01–0.5%, the Co content of 0.01–0.5%, and the contents of B and Al are 0.0001–0.1% and 0.001–0.05%, respectively, and further, at least one of the following content requirements is satisfied: the Ca content of 0.0001–0.01%, the Mg content of 0.0001–0.01% and the Nd content of 0.0001–0.01%.

17. The heat resistant steel according to claim 16, wherein the contents of the impurities P and S are not more than 0.03% by mass and not more than 0.015% by mass, respectively.

18. A heat resistant steel excellent in strength at elevated temperatures which comprises, by mass %, C: 0.01–0.25%, Cr: 0.5–8%, V: 0.05–0.5%, Si: not more than 0.7% and Mn: not more than 1%, with Fe and impurities accounting for the balance, in which coherent precipitates having an average diameter of not more than 30 nm as confirmable upon observation of a section of the steel using a transmission electron microscope at an accelerating voltage of not lower than 100 kV are present inside grains at a density of not less than $1/\mu m^3$ and in which grain boundary precipitates of at least one species selected from among cementites, $M_7C_3$ carbides and $M_{23}C_6$ carbides are present at grain boundaries, the amount of V among the metal elements constituting each grain boundary precipitate being not less than 2% by mass, the value of the ratio between the length of the minor axis and major axis "minor axis/major axis" thereof being not less than 0.5.

19. The heat resistant steel according to claim 18, which further comprises an element or elements of one or more groups selected from the groups (a) to (g) listed below in lieu of part of Fe:

(a): one or more selected from among Nb: 0.002–0.2%, Ti: 0.001–0.1% and Ta: 0.002–0.2% by mass;

(b): N: 0.001–0.1% by mass;

(c): one or both of Mo: 0.01–2.5% and W: 0.02–5% by mass;

(d): B: 0.0001–0.1% by mass;

(e): one or more selected from among Co: 0.01–0.5%, Ni: 0.01–0.5% and Cu: 0.01–0.5% by mass;

(f): Al: 0.001–0.05% by mass; and (g): one or both of Ca: 0.0001–0.01% and Mg: 0.0001–0.01% by mass.

20. The heat resistant steel according to claim 19, wherein the contents of P and S as impurities are not more than 0.03% and not more than 0.015% by mass, respectively.

* * * * *